United States Patent [19]

Kanoi et al.

[11] 4,442,419

[45] Apr. 10, 1984

[54] STATIC INDUCTION APPARATUS

[75] Inventors: Minoru Kanoi, Ibaraki; Yasuro Hori, Katsuta; Masaaki Maejima, Hitachi, all of Japan

[73] Assignee: Hitachi, Ltd., Tokyo, Japan

[21] Appl. No.: 306,868

[22] Filed: Sep. 29, 1981

[30] Foreign Application Priority Data

Sep. 30, 1980 [JP] Japan ..... 55-136879

[51] Int. Cl.[3] ..... H01F 15/00

[52] U.S. Cl. ..... 336/100; 181/202; 181/208; 188/379

[58] Field of Search ..... 181/202, 207, 208; 188/379, 380; 336/100

[56] References Cited

U.S. PATENT DOCUMENTS 4,371,858 2/1983 Kanoi et al. ..... 336/100

FOREIGN PATENT DOCUMENTS 523671 11/1953 Belgium ..... 181/202
1112311 8/1961 Fed. Rep. of Germany ..... 181/207
4511330 6/1966 Japan ..... 336/100
4516124 6/1966 Japan ..... 336/100
48-41848 12/1973 Japan .
50-135906 11/1975 Japan .
826501 1/1960 United Kingdom ..... 336/100
1094618 12/1963 United Kingdom ..... 181/202

*Primary Examiner*—Thomas J. Kozma
*Attorney, Agent, or Firm*—Antonelli, Terry & Wands

[57] ABSTRACT

A static induction apparatus including a vessel for containing a main body of the static induction apparatus, a plurality of reinforcing support members secured to side plates of the vessel and a sound reducing structure. The sound reducing structure includes a plurality of sound reducing members supported between the reinforcing support members and each including a sound insulating panel composed of high damping metal plate, a resilient plate formed of thin metal sheet material interposed between the sound insulating panel and the reinforcing members, and a weight member secured to the vicinity of the boundary between the sound insulating panel and the resilient plate.

6 Claims, 6 Drawing Figures

STATIC INDUCTION APPARATUS

BACKGROUND OF THE INVENTION

1. Field of the Invention

This invention relates to static induction apparatus, such as transformers, reactors, etc., and, more particularly, to a type of static induction apparatus provided with an improved noise reducing structure.

2. Description of the Prior Art

Generally, as fast-growing urban communities encroach upon the rural districts, housing for the growing number of urban workers tends to be located close to a substation, and a demand for reducing the noise generated by a static induction apparatus arises. Almost all the noises generated by a static induction apparatus are caused by vibration produced in the iron core of the apparatus and radiated into the atmosphere from the vessel after being transmitted through the bottom plate and insulating oil in the transformer. In one known method for reducing the noise, a sound reducing shed is built of conrete and iron sheets and used for reducing noise. Some disadvantages are associated with this method. For example, the area in which the equipment is installed increases, the cost rises and the period for carrying out work is prolonged.

In another known method, for reducing noise production by the side plates of a vessel, a frame formed of rubber or other resilient material is mounted at the peripheral end of each of reinforcing support members for supporting a sound insulating panel. When this method is used, there is the disadvantage that vibration is transmitted from the reinforcing support members to the sound insulating panel and the sound absorbing performance is reduced, because the spring constant of the resilient material cannot be sufficiently lowered due to limitations placed by the static displacement and the earthquake resisting performance of the sound insulating panel, although the transmission loss of the sound insulating panel itself is sufficiently large. When insulation rubber is used as resilient material, this material raises problems with regard to its weatherproof properties, reliability in performance, and cost.

SUMMARY OF THE INVENTION

This invention has been developed for the purpose of obviating the disadvantages of the prior art. Accordingly, the invention has as its object the provision of a static induction apparatus capable of greatly reducing the vibration transmitted from the reinforcing support members to the sound insulating panel, to thereby efficiently reduce noise production.

According to the invention, there is provided a static induction apparatus comprising a vessel for containing a main body of the static induction apparatus, a plurality of reinforcing support members secured to a side plate of the vessel, and sound reducing means supported between the reinforcing support members, the sound reducing means including a sound insulating panel composed of high damping metal plate, a resilient plate formed of thin metal sheet material interposed between the sound insulating panel and the reinforcing support members, and a weight member secured to the vicinity of the boundary between the sound insulating panel and the resilient plate.

Additional and other objects, features and advantages of the invention will become apparent from the description set forth hereinafter when considered in conjunction with the accompanying drawings.

DETAILED DESCRIPTION OF THE DRAWINGS

Figure 1:
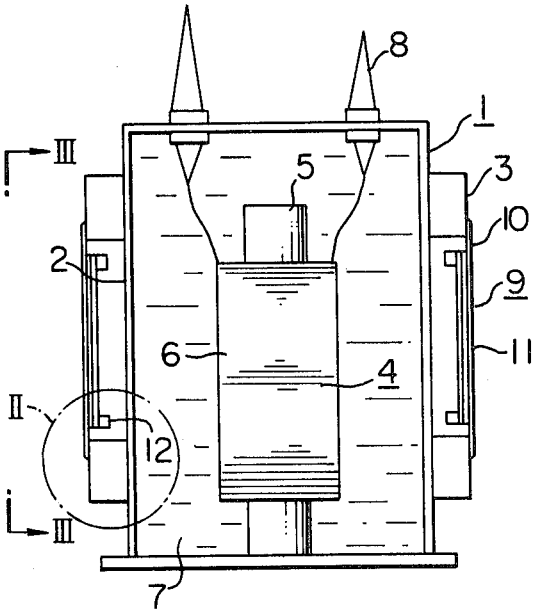
FIG. 1 is a vertical sectional view of the static induction apparatus in accordance with a first embodiment of the invention.
Figure 2:
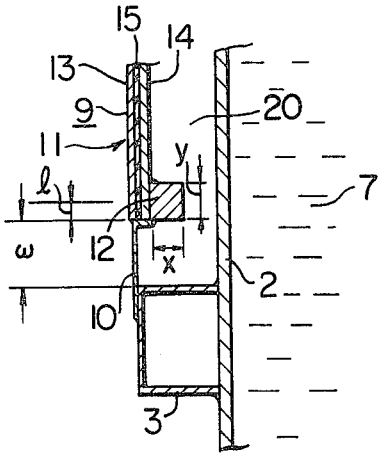
FIG. 2 is a view, on an enlarged scale, showing the section II shown in FIG. 1.
Figure 3:
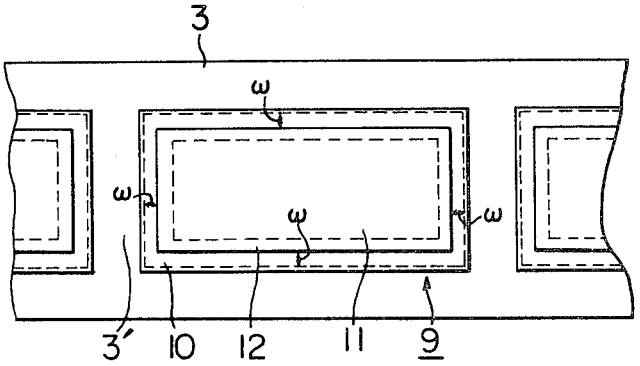
FIG. 3 is a view taken in the direction of arrows III—III shown in FIG. 1.

As shown in FIGS. 1–3, a vessel generally designated by the reference numeral 1 has side plates 2 each provided with reinforcing stays or support members 3 (which may be constituted by any web-like protuberances, such as flanges, on the side plates) arranged horizontally in two layers vertically spaced apart from each other. A plurality of reinforcing stays or support members 3', similar to the reinforcing support members 3, are arranged vertically on the side plates 2 between the horizontally extending reinforcing support members 3, so as to define a plurality of rectangular window-like sections by the horizontal and vertical reinforcing support members 3 and 3'. A main body generally designated by the reference numeral 4 of the static induction apparatus comprising an iron core 5 and a coil 6 wound around the iron core 5 and is located in the vessel 1 which also contains a mineral oil 7 serving as a transformer oil for effecting insulation and cooling. Bushings 8 are mounted on the top of the vessel 1 for connecting the coil 6 to external bus lines.

Sound reducing members generally designated by reference numeral 9 are each mounted between the two horizontal reinforcing support members 3 and the two vertical reinforcing support members 3' and comprise, as shown in detail in FIGS. 2 and 3, a resilient plate 10 formed of thin sheet metal, such as sheet steel, secured at the vicinity of the outer peripheral edges to the peripheral edges of the reinforcing support members 3 and 3', a sound insulating panel generally designated by the reference numeral 11 secured to the inner peripheral edges of the resilient plate 10, and an annular weight member 12, formed of metal, secured to the vicinity of the boundary between the resilient plate 10 and the sound insulating panel 11. The sound insulating panel 11 is composed of a high damping metal plate which includes a plurality of thin metal sheets 13 and 14, such as thin sheet steel, and a layer 15 of viscoelastic material, such as rubber, plastics, etc., interposed between the metal sheets 13 and 14. The sound reducing member 9 is suitably mounted in a position between the plurality of reinforcing support members 3 and 3' that requires sound insulation.

Preferably the resilient plate 10, sound insulating panel 11 and the weight member 12 are secured to one another by welding. As shown in FIG. 2, the weight member 12 may be welded to the sound insulating panel 11 in a position thereof which is adjacent the resilient plate 10, or to the resilient plate 10 in a position thereof which is adjacent the sound insulating panel 11. However, when the weight member 12 is welded to the resilient plate 10 of thin sheet metal, there is the risk that the resilient plate 10 might be damaged by the heat generatd by welding. Thus, the weight member 12 is preferably welded to the sound insulating panel 11 of a relatively larger thickness as shown.

As can be clearly seen in FIG. 3, the weight member 12 is of unitary structure, not divided into a plurality of isolated parts, which continuously extends along the outer lines or peripheral lines of the sound insulating panel 11 in the vicinity of the boundary between the resilient plate 10 and the sound insulating panel 11. This construction is advantageous in improving the vibration damping effect of the sound insulating panel 11. More specifically, if the weight member 12 were divided into a plurality of isolated parts located in spaced-apart relation along the peripheral edge of the sound insulating panel 11, vibration could not be damped in portions of the sound insulating panel 11 near its peripheral edge where no parts of the weight member 12 are mounted, making it difficult to achieve the desired vibration damping effect.

Generally, electromagnetic vibration generated by the iron core 5 is transmitted from the right side in FIG. 2 to the side plates 2 through the mineral oil 7. As a result, bending vibration is produced in the vessel 1 and noise is radiated to the atmosphere. Generally, vibration is higher in magnitude in portions of the side plates 2 in which no reinforcing support members 3 and 3' are mounted than in portions thereof in which the reinforcing support members 3 and 3' are mounted. Thus, great noise is generated in the portions of the side plates 2 having no reinforcing support members 3 and 3', but most of the noise is suppressed by the sound insulating panel 11. In this case, it is possible to mount, as is well known, a sound absorbing material inside a cell 20 between the sound reducing member 9 and the side plate 2, to achieve sound absorbing effect. If vibration is transmitted from the reinforcing support members 3 and 3' to the sound insulating panel 11, the sound insulating effect would be reduced because the sound insulating panel 11 itself becomes a sound generating member. Thus, it has been customary to avoid transmission of vibration by connecting the reinforcing support members 3, 3' to the sound insulating panel 11 through, for example, insulation rubber. However, this device has been low in practical value because of the need to reduce the spring constant of the insulation rubber to a substantial level and in view of high cost and low performance.

To obviate the aforesaid disadvantages of the prior art, the plate spring action of the resilient plate 10, formed of thin sheet metal, is utilized in place of the resilience of the insulation rubber of the prior art in the embodiment of the invention shown and described hereinabove. Thus, even if the resilient member 10 has a practical spring constant in construction, it is possible to damp the vibration of a low frequency range or the range of between 100 and 300 Hz of the sound insulating panel 11, by virtue of the mass effect achieved by the weight member 12 secured to the vicinity of the boundary between the resilient member 10 and the sound insulating panel 11. Meanwhile, the resilient member 10 has the effect of damping vibration of a high frequency range or above 300 Hz to a certain degree. However, the provision of the resilient member 10 only would increase the vibration transmitted in a resonance frequency of a high frequency range of the sound insulating panel 11. To avoid this defect, the sound insulating panel 11, composed of high damping metal plate, is used according to the invention in addition to the resilient member 10, to damp the vibration that is transmitted by changing energy of vibration to thermal energy. Additionally, the use of the high damping metal plate has the synergystic effect of reducing vibration in a low frequency range when combined with the use of the resilient plate 10 and the weight member 12.

Experiments were conducted by us to ascertain the vibration damping effect achieved by the vibration damping structure of the static induction apparatus according to the first embodiment of the invention. In the experiments, the resilient member 10, the sound insulating panel 11, and the weight member 12 used were, as described hereinbelow, and the distance l between the outer lines of the sound insulating panel 11 and the center of the weight member 12 was varied to obtain data on the amount of noise that can be reduced.

Resilient plate 10: sheet steel of a thickness of 1.6 mm and width W of 100 mm (FIGS. 2 and 3).

Sound insulating panel 11: high damping steel sheet material of an overall thickness of 4.24 mm composed of the thin metal sheets 13 and 14 of 2.1 mm each in thickness, and the visco-elastic material layer 15 of 0.04 mm in thickness.

Weight member 12: steel plate of a rectangular transverse cross section having a depth x and a height y (FIG. 2) of 50 mm each.

The results of the experiments show that, when the distance l was 25 mm, the noise was reduced by 10 dB (A) through the entire frequency range of 100 to 600 Hz. When the distance l was 75 mm, the noise increased by 12 dB as compared with the noise produced when the distance l was 25 mm. When the distance l was 125 mm, the noise increased by 10 dB as compared with the noise produced when the distance was 25 mm. Thus, when the distance l was 125 mm, the mechanism was unable to achieve the effect of reducing noise; and, when the distance l was 75 mm, the noise increased by 2 dB.

It is important, therefore, that the weight member 12 be located at the peripery of the sound insulating panel 11. In the embodiment shown and described hereinabove, the gap between the outer periphery of the weight member 12 and the peripheral edge of the sound insulating panel 11 is preferably below about 10 mm for reducing noise effectively. When the distance l is 25 mm, there should be no such gap.

In the embodiment shown and described hereinabove, in order to effectively reduce noise, the mass of the weight member 12 is preferably over 50% of the total mass of the weight member 12 and the sound insulating panel 11, preferably, over 60% thereof. The sound insulating panel 11 preferably has a surface density of $10^{-5}$ kg/mm$^2$ or more. When measured in terms of the thickness of a steel sheet, it corresponds in value to about 3 mm. The resilient plate 10 preferably has a thickness which is below one-half that of the sound insulating panel 11.

From the foregoing description, it will be appreciated that, in the static induction apparatus according to a first embodiment of the invention, the use of the sound insulating panel 11 having a sound insulating function and the use of the weight member 12 mounted in the vicinity of the boundary between the sound insulating panel 11 and the resilient plate 10 and having a vibration damping function can achieve the synergystic effect of reducing the vibration transmitted from the reinforcing support members 3, 3' to the sound insulating panel 11 in a wide frequency range extending from a low frequency range to a high frequency range. It is also possible to reduce noise generated by electromagnetic vibration and the high harmonic oscillation produced thereby, so that sound can be insulated by the sound insulating panel 11 to thereby reduce noise production. The use of resilient plate 10 made of thin metal sheets, is advantageous as compared with the use of insulation rubber in the prior art, both in improving weatherproof properties and reliability in performance and from the economical point of view.

As can be clearly seen in the results of the experiments described hereinabove, it is possible to achieve excellent vibration damping effect by reducing the distance between the outer periphery of the sound insulating panel 11 and the center of the weight member 12, or by positioning the weight member 12 as close as possible to the boundary between the sound insulating panel 11 and the resilient member 10. Thus, by mounting the weight member 12 in a suitable position in the vicinity of the boundary between the sound insulating panel 11 and the resilient plate 10, it is possible to effectively reduce noise production by using a sound reducing member of relatively light weight. Moreover, since the weight member 12 is secured to the inner surface of the sound insulating panel 11 and does not project outwardly, there is no risk of the weight member 12 spoiling the external appearance of the static induction apparatus.

Figure 4:
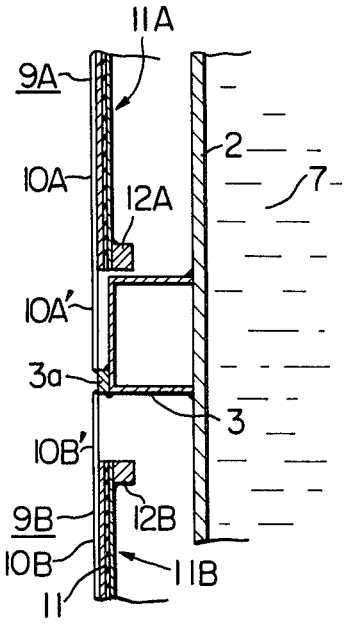
FIG. 4 is a view similar to FIG. 2 but showing the static induction apparatus according to a second embodiment of the invention.

As shown in FIG. 4, more than three reinforcing support members 3 (only one reinforcing support member interposed between the upper and lower reinforcing support members is shown) extending horizontally are mounted on each side plate 2 of the vessel 1 containing the mineral oil 7, and sound reducing members 9A and 9B are interposed between the two reinforcing support members 3. Like the sound reducing members 9 of the first embodiment, the sound reducing members 9A and 9B comprise sound insulating panels generally designated by the reference numerals 11A and 11B, resilient plates 10A' and 10B' and weight members 12A and 12B, respectively. The sound reducing member 9A of the second embodiment is distinct from the sound reducing member 9 of the first embodiment, however, in that the resilient plate 10A' thereof is constituted by a portion of a thin metal sheet 10A joined by spot welding in several positions to the sound insulating panel 11A in such a manner so as to enclose the outer surface of the same that extends beyond the end edge portion of the sound insulating panel 9A. Likewise, the resilient plate 10B' of the sound reducing member 9B is constituted by a portion of a thin sheet metal 10B joined by spot welding in several positions to the sound insulating panel 11B in such a manner so as to enclose the outer surface of the same that extends beyond the end edge portion of the sound insulating panel 9B.

The resilient plate 10A' is secured at its lower edge portion to a projection **3*a* projecting from a lower left corner (as viewed in FIG. 4) of the reinforcing support member 3, and the resilient plate 10B' is secured at its upper edge portion to the projection 3*a***.

In the second embodiment of the invention, the reinforcing support members 3 are shielded from outside by the sound reducing members 9A and 9B. Thus, the second embodiment is capable of achieving, in addition to the effects achieved by the first embodiment, the effect of being able to reduce noise generated by the reinforcing support members 3. The arrangement whereby the sound insulating panels 11A and 11B, are joined by welding to the thin metal sheets 10A and 10B, respectively, in several positions offers the additional advantage that when vibration is transmitted to the sound insulating panels 11A and 11B, vibration damping effect can be achieved by friction between portions of the sound insulating panels and portions of the thin metal sheets interposed between the spot welds.

In the embodiment shown in FIG. 4, the lower edge portion of the resilient plate 10A' and the upper edge portion of the resilient plate 10B' are secured to the lower left corner of the reinforcing support member 3 through the projection **3*a*. It is possible to secure them to the upper left corner of the reinforcing support member 3, not the lower left corner thereof as shown and described. Since a corner of the reinforcing support member 3 provides difficult vibrations, the lower edge portion of the thin metal sheet 10A' and the upper edge portion of the thin metal sheet 10B' are preferably secured to the reinforcing support member 3** in a position as close to its corner as possible.

Figure 5:
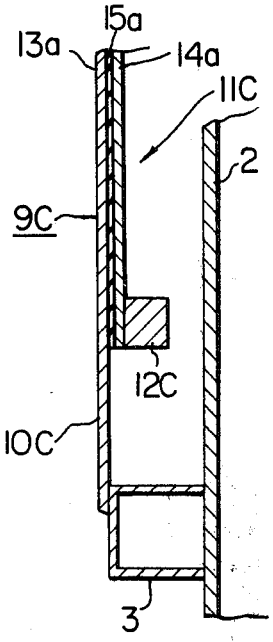
FIG. 5 is a view similar to FIG. 2 but showing the static induction apparatus according to a third embodiment of the invention.

FIG. 5 shows a third embodiment of the invention which is distinct from the first embodiment in the construction of the sound reducing member 9C. More specifically, in FIG. 5, an outer thin metal sheet **13*a* of a sound insulating panel generally designated by the reference numeral 11C, composed of high damping metal plate, is larger in size than an inner thin metal sheet 14*a* and a viscoelastic material layer 15*a*, and a portion of the outer thin metal sheet 13*a*, that extends beyond the end edges of the inner thin metal sheet 14*a*, and the viscoelastic material layer 15*a* constitutes a resilient plate 10C**.

Except for the aforesaid differences between the first and third embodiments, the third embodiment is essentially similar to the first embodiment in construction and can achieve similar effects, and the resilient plate 10C is secured in the vicinity of its outer edge to the vicinity of the peripheral lines of the reinforcing support member 3 projecting from the side plate 2 or the vicinity of the inner corner (upper left corner in FIG. 5) thereof. A weight member 12C is secured to the inner surface of the sound insulating panel 11C in the vicinity of the boundary between the resilient plate 10C and the sound insulating panel.

Figure 6:
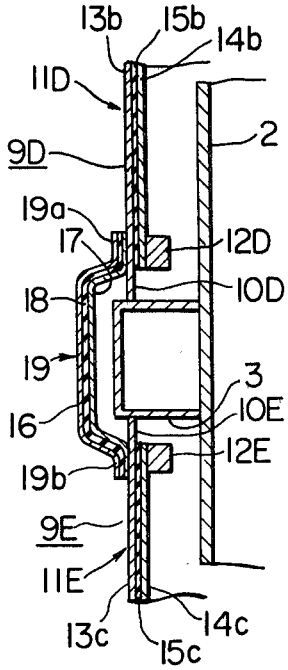
FIG. 6 is a view similar to FIG. 2 but showing the static induction apparatus according to a fourth embodiment of the invention.

FIG. 6 shows a fourth embodiment of the invention, in which more than three horizontally extending reinforcing support members are mounted on the side plates 2 of the vessel 1 (only one reinforcing support member 3 is shown) and sound reducing members 9D and 9E are mounted between the reinforcing support members 3, as is the case with the first embodiment. The sound reducing members 9D and 9E are of the same construction as the sound reducing members 9C shown in FIG. 5. More specifically, an outer thin metal sheet **13*b* of a sound insulating panel generally designated by the reference numeral 11D of the sound reducing member 9D is larger in size than an inner thin metal sheet 14*b* of the sound insulating panel 11D and a viscoelastic material layer 15*b*, and a portion of the outer thin metal sheet 13*b*, extending beyond the end edges of the inner thin metal sheet 14b and the viscoelastic material layer 15b, constitutes a resilient plate 10D. An outer thin metal sheet 13c of a sound insulating panel generally designated by the reference numeral 11E of the sound reducing member 9E is larger in size than an inner thin metal sheet 14c of the sound insulating plate 11E and a viscoelastic material layer 15c, and a portion of the outer thin metal sheet 13c, extending beyond the end edges of the inner thin metal sheet 14c and the viscoelastic material layer 15c, constitutes a resilient plate 10E**.

The resilient plates 10D and 10E are secured at their lower edge portion and upper edge portion to the reinforcing support member 3 at its upper left corner and at its lower left corner (as viewed in FIG. 6), respectively. Weight members 12D and 12E, similar to the corresponding members of the first to third embodiments, are secured on the inner surface of the sound insulating panel 11D in the vicinity of the boundary between the resilient plate 10D and the sound insulating panel 11D and to the inner surface of the sound insulating panel 11E in the vicinity of the boundary between the resilient plate 10E and the sound insulating panel 11E respectively.

The resilient plates 10D and 10E and the reinforcing support member 3 are enclosed by a sound insulating cover 19 secured at one flange end 19a to the outer surface of the sound insulating panel 11D in a position juxtaposed against the weight member 12D and, at the other flange end 19b, to the outer surface of the second insulating panel 11E in a position juxtaposed against the weight member 12E, so that the resilient plates 10D and 10E and the reinforcing support member 3 are shielded from outside. The sound insulating cover 19 is composed of a high damping metal plate comprising a plurality of thin metal sheets 16 and 17, and a viscoelastic material 18 formed of rubber, plastics, etc., interposed between the thin metal sheets 16 and 17.

The fourth embodiment can achieve, in addition to the effects achieved by the third embodiment, the following effects. More specifically, the arrangement whereby the resilient plates 10D and 10E and the reinforcing support member 3 are enclosed by the sound insulating cover 19 composed of high damping metal plate enables radiation of vibration from the resilient members 10D and 10E and the reinforcing support member 3 to be prevented. The arrangement whereby the sound insulating cover 19 is secured to the sound insulating panels 11D and 11E in positions in which the weight members 12D and 12E are located and vibration is small enables insulation of noise by the sound insulating cover 19 to be effected preferably.

It is to be understood that the invention can be worked in manners different from the embodiments shown and described. For example, the unitary structure of the sound insulating panel and the resilient plate shown in FIG. 5 may be used in the embodiment shown in FIG. 4, and the sound insulating panel and the resilient plate of the construction shown in FIG. 2 may be used in the embodiment shown in FIG. 6. The weight member may be arranged outside the sound insulating panel.

From the foregoing description, it will be appreciated that the static induction apparatus according to the invention comprises an improved sound reducing structure capable of effectively reducing noise production by greatly damping vibration transmitted from the reinforcing support member to the sound insulating panel.

What is claimed is:

1. A static induction apparatus comprising:

a vessel containing a main body of said static induction apparatus;

a plurality of reinforcing support members secured to a side plate of said vessel; and sound reducing means supported between said reinforcing support members;

said sound reducing means including a sound insulating panel composed of a high damping metal plate formed of a plurality of thin metal sheets having a layer of viscoelastic material interposed between adjacent metal sheets, a resilient plate formed of a thin metal sheet material interposed between said sound insulating panel and said reinforcing support members, and a weight member disposed only about an outer peripheral portion of the sound insulating panel and secured to the sound insulating panel only in an area of a boundary between said sound insulating panel and said resilient plate.

2. A static induction apparatus as claimed in claim 1, wherein said resilient plate includes a thin metal sheet welded at the vicinity of an inner edge thereof to the vicinity of outer edge of said sound insulating panel and welded at the vicinity of an outer edge to said reinforcing support member.

3. A static induction apparatus as claimed in claim 1, wherein said resilient plate is constituted by a portion of a thin metal sheet which extends beyond the outer edge of said sound insulating panel, the latter thin metal sheet being joined by spot welding to the outer surface of said sound insulating panel and covering said outer surface.

4. A static induction apparatus as claimed in claim 1, wherein an outermost thin metal sheet of said sound insulating panel includes a projection portion extending beyond outer edges of the other of said plurality of thin metal sheets and the viscoelastic material layer of said sound insulating panel to said reinforcing support members, said projecting portion constituting said resilient plate.

5. A static induction apparatus as claimed in any one of claims 1–4, wherein said weight member is welded to an inner surface of said sound insulating panel in a position adjacent the boundary between said sound insulating panel and said resilient plate.

6. A static induction apparatus as claimed in any one of claims 1–4, wherein said weight member is of a unitary structure extending continuously along the outer peripheral edge of said sound insulating panel.

* * * * *